United States Patent [19]

Mazzini

[11] 4,338,974

[45] Jul. 13, 1982

[54] CONTROL DEVICE FOR RECIPROCATING GRIPPERS IN SHUTTLELESS LOOMS

[76] Inventor: Mazzino Mazzini, Via Serragliolo, 39 - Agliana - (Province of Pistoia), Italy

[21] Appl. No.: 139,497

[22] Filed: Apr. 11, 1980

[51] Int. Cl.[3] ..... D03D 47/00

[52] U.S. Cl. ..... 139/449

[58] Field of Search ..... 139/449, 440, 446, 443

[56] References Cited

U.S. PATENT DOCUMENTS

| | | | |
|---|---|---|---|
| 2,066,532 | 1/1937 | Kellogg et al. | 139/449 |
| 3,735,783 | 5/1973 | Fritz et al. | 139/449 |
| 4,127,150 | 11/1978 | Steverlynck | 139/449 |

FOREIGN PATENT DOCUMENTS

| | | | |
|---|---|---|---|
| 672399 | 10/1964 | Italy | 139/449 |

*Primary Examiner*—Henry Jaudon

*Attorney, Agent, or Firm*—Guido Modiano; Albert Josif

[57] ABSTRACT

Actuating device for the reciprocating movement of the belts carrying the weft thread insertion grippers in shuttleless looms. Each belt is provided with a lengthwise series of slots and with the slots of one series a respective gear wheel is in mesh engagement. An oscillating gear sector drives the gear wheel. The gear sector has along the bisecting line thereof a slotted link coupling including a slider. The coupling provides articulation both with the big end of a connecting rod in a crank mechanism, which is driven by a cyclic shaft of the shuttleless loom, and with the pin of a rocker arm following the oscillations of the gear sector.

The law of motion determined by the cooperation of the slotted link coupling and the slider causes variation of the transmitted speed, acceleration and stroke, particularly near the two dead points of oscillation of the sector thereby improving the operations of the grippers to which such motion is transmitted.

9 Claims, 3 Drawing Figures

CONTROL DEVICE FOR RECIPROCATING GRIPPERS IN SHUTTLELESS LOOMS

BACKGROUND OF THE INVENTION

This invention relates generally to shuttleless looms with reciprocating weft inserting grippers and in particular to an actuating mechanism for such weft inserting grippers.

As is known, in shuttleless looms, the weft thread is inserted by means of two suitably designed grippers (sometimes called needles or darts, depending of their different shapes). During the long standstill phase of the comb and related opening of the shed, the two grippers, which are carried cantilever-fashion by the respective sides of the loom, are first moved toward each other, starting from such sides, and then, after meeting at the center of the loom and handling over the weft thread, returned to the loom sides to allow the comb beating up.

Also known are shuttleless looms wherein each such gripper is secured at one end to a respective flexible belt, arranged to slide in a sort of arcuate guide. The two arcuate guides extend in a vertical plane lying parallel to the loom front and project out of said sides, and sometimes depend downwards from the loom, such as not to interfere with the oscillations of the sley to which the comb is mounted. Moreover, each belt is provided with a lengthwise series of slots, in mesh engagement with the teeth of a respective gear or toothed wheel which is driven to reciprocate rotatively in either directions, thereby the belt is moved out of the guide and the related gripper is brought to the loom center, and vice-versa, the belt is withdrawn and the gripper moved back.

Numerous are the aspects of the types of control utilized in the past for such gear wheels which have failed to prove fully satisfactory. For example, with the currently employed controls, the belts of the weft inserting grippers do not have sufficiently low speeds and accelerations to ensure, at the gripper travel limit corresponding to the loom center, a correct transfer of the weft thread from one gripper to the other. Furthermore the bulk size of the looms is considerable, and so are the travel sections covered by the grippers during their return stroke after leaving the reed.

Other drawbacks are due to the conventional controls being less than entirely suitable for application to looms having, within a certain range, a front of different useful extension.

This invention sets out to obviate the cited shortcomings.

SUMMARY OF THE INVENTION

According to one aspect of the present invention, there is provided an actuating device for the reciprocating movement of the transmission systems carrying the weft thread insertion grippers in shuttleless looms, wherein each transmission system is driven by a respective gear wheel, characterized in that it comprises between at least one of said gear wheels and a connecting rod and crank assembly driven by a cyclic shaft of the shuttleless loom, an oscillating gear sector, driving said gear wheel, said gear sector having substantially along the bisecting line thereof a slotted link type coupling including a slider said coupling providing articulation both with an end of a linkage member of said connecting rod and crank assembly and with a pin of a rocker arm following the oscillations of said gear sector, thereby to guide the movement of said linkage member end.

BRIEF DESCRIPTION OF THE DRAWING

Further features will be more clearly apparent from the description of a preferred, though not limitative, embodiment of this control, illustrated by way of example only in the accompanying drawing, where.

DESCRIPTION OF THE PREFERRED EMBODIMENTS

Figure 3:
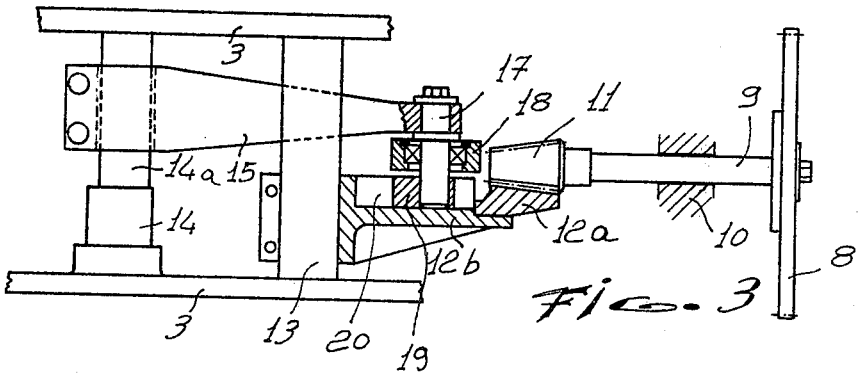
FIG. 3 is a partly sectional plan view of the control shown in FIG. 2, as taken along the line III—III of FIG. 2.

With reference to the drawing figures, the numeral 1 designates the reed of a shuttleless loom. A lower reinforcement 2 of the reed is attached to a sley, not shown, which can be oscillated, in a known manner, about a horizontal axis extending parallel to the loom front and being located between the two sides of the same. Parallel to each such side there extend a respective pair of vertical supporting elements 3, which are also connected to that side externally thereto.

On the front, the reinforcement 2 has a threshold 2*a*, which is covered by a special gasket and upon which two grippers 4 and 5 are arranged to slide, which grippers are attached each to the top end of a respective belt 6. The grippers 4 and 5 serve for inserting the weft thread; the gripper 4 can be, for example, the one intended for picking up the weft thread, or pulling gripper, whilst the gripper 5 can fulfill the function of inserting and deliver the weft thread to the preceding gripper.

The belts 6 are flexible and arranged for sliding in a sort of guides or sheathes 7, which extend in a common plane parallel to the loom front. Starting from its top end, contiguous to a respective end of the reed 1, each guide 7 has a rectilinear section or portion which, outside of the related loom side, extends downwards into an arcuate section or portion, which may be terminated with a lower or bottom rectilinear section facing the loom center.

The belts 6 are flattened horizontally, parallel to the loom sides. Each belt is provided with a lengthwise series of engagement formations or slots (symbolically indicated with reference numeral 6*a*) which are distributed at regular intervals. With the slots in one series, there mesh engages a gear or toothed wheel 8 which is keyed to one end of a related shaft 9. Each shaft 9 is carried pivotally by a bearing 10 which is laid horizontal and parallel to the vertical elements 3 in the proximity of the top end of the respective guide 7, through which passes the wheel 8 to mesh with the related belt 6.

At the end of each shaft 9 remote from the gear wheel 8, there is keyed a bevel pinion gear 11 which meshes with a portion of a bevel gear or gear ring segment 12*a*, secured to a sector 12*b*. Each toothed sector or gear segment 12*a*-12*b* is journalled between the respective pair of vertical elements 3; it is, in fact, secured to a pin 13 which is carried pivotally by said vertical elements 3 and is perpendicular thereto. It will be understood that the pin 13 constitutes supporting shaft means for pivotally supporting said gear sector 12*a*, 12*b* and defines an axis of oscillation thereof.

The pair of vertical elements 3 also carries a second pin 14, parallel and coplanar with the pin 13 but located, with respect to the pin 13, on the side remote from the wheel 8. The second pin 14 acts as the pivot for a rocker arm 15. In particular, the second pin 14 has an eccentric portion 14*a* which acquires variable distance from the pin 13 depending on the angular position in which the second pin 14 is locked with respect to the vertical elements 3. With the interposition of a bushing, the rocker arm 15 is mounted pivotally to the portion 14*a*, thereby its pivot is at an adjustable distance from the pin 13 of the gear sector 12*a*-12*b*. It will thus be appreciated from the foregoing that the eccentric pivot portion 14*a* has an eccentric axis about which the rocker arm 15 actually rotates, while the pivot 14 has a main axis offset with respect of the eccentric axis about which the angular adjustment of the pin 14 is effected. As it appears from FIG. 2 the rocker arm 15 has an arcuated shape adapted to bypass the pin 13 thereby to avoid interference therewith during the oscillation of the rocker arm 15.

Pivotally connected to a first extension 17' of the terminating pin 17 of the rocker arm 15 is the small end 18' of a connecting rod 18 and to a further extension 17'' of the terminating pin 17 a slider 19, which is slot linked at 20 to the sector 12*b*, the slot link i.e. the raceway forming the slot link 20 extending along the bisecting line 12*c* of said sector. It will be understood that the extensions 17' and 17'' of the pin 17 constitute a linkage member with an articulation end for the connecting rod 18, the slider 19 and the rocker arm 15. Thus, the rocker arm 15 follows the oscillations of the gear sector 12*a*-12*b* in the same direction. The big end of the connecting rod 18 is articulated to a second pin 21 of a crank 22 which is keyed to one end of a shaft 23. The shaft 23, extending parallel to the loom front and located between the sides of the same, is driven to complete one revolution per cycle of the loom. The crank mechanisms or the connecting rod and crank assembly 22-18, located at the ends of the shaft 23 and being driven thereby, convert the rotary motion of the shaft 23 into a reciprocating movement of the respective gear sectors 12*a*-12*b* and respective wheels 8, such that while one wheel turns in one direction the other turns in the opposite direction.

Figure 2:
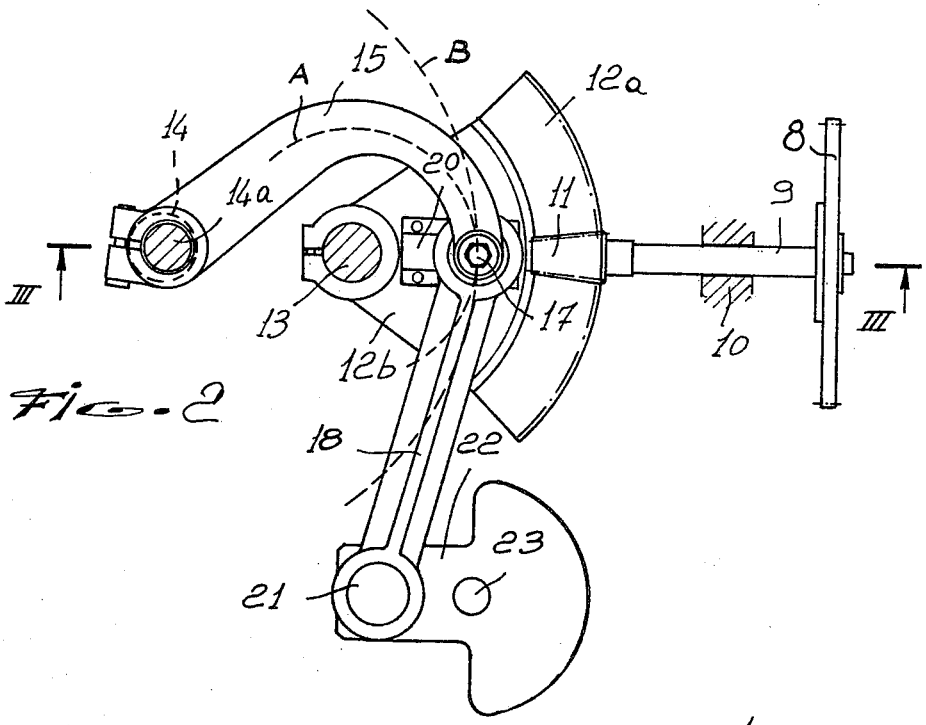
FIG. 2 is a detail view of a control according to this invention, as viewed from one side of the loom.
Figure 1:
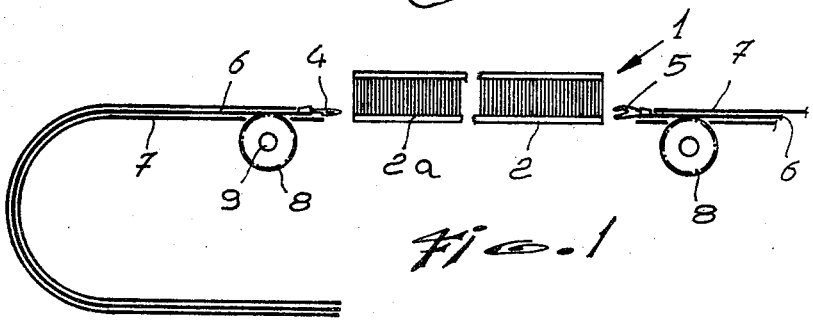
FIG. 1 is a diagrammatical partial front view of a shuttleless loom.

As it appears clearly from FIG. 2 of the drawing FIG. 2, the shaft 9 of the toothed wheel 8 intersects the axis of oscillation 13 of the gear sector 12*a*-12*b*. Furthermore as it appears clear from FIG. 2 the crank 22 is arranged laterally at a distance from the gear sector 12*a*-12*b* so that there is always a significant angle between the rocker arm 15 and the connecting rod 18.

The control described in the foregoing operates as follows.

When the reed 1 is at a standstill in the position where its lower reinforcement is aligned with the top sections of the guides 7, the belts 6 are controlled to move out of the same and insert the grippers 4 and 5 through the warp thread shed. The grippers reach as far as the center of the loom, and the gripper 5 delivers the weft thread to the gripper 4. At this stage, the wheels 8 reverse their rotations and control the belts 6 to move back into the guides 7, thereby the grippers are withdrawn. As the grippers withdraw from the reed 2, the reed rapidly completes its oscillation to beat in the weft inserted in the fabric and then returns to its conditions in alignment with the top sections of the guides 7. The simultaneous engagement of the slotted link 20 of the sector 12*b* by the rocker arm 15 and conrod 18 of the crank mechanism, as driven by the cyclic shaft 23, produces the aforesaid favourable laws of motion of the grippers 4 and 5 at their end of stroke positions, respectively at the center and sides of the loom.

It should be observed that these favourable laws of motion are determined by the fact that, whereas in the position indicated in FIG. 2 of the pin 17 a material point of the sector 12*b* lying at the considered moment on the axis of the pin 17 is moved subsequently along a path coinciding with the circular arc A the radius of which converges towards the center of the pin 13, instead the pin 17 itself is moved subsequently to the considered moment along a path coinciding with the circular arc B the radius of which converges towards the center of the pivot 14*a* and is therefore greater than the radius of the circular arc A. Consequently near the two dead points of the oscillation of the sector 12*b* the law of motion is determined by the greater radius of the circular arc B so that on the one hand there is obtained a reduction of the stroke of the grippers, which otherwise would have been greater, and on the other side a variation of the speed and of the accelerations is obtained during the stroke, which variations favour the gripping and the releasing action of the weft performed by the grippers.

It should be further noted that the adjustment of the angular position of the pin 14, and accordingly of the distance of the pivot 14*a* of the rocker arm 15 from the pivot 13 of the gear sector 12*a*-12*b*, affords the possibility of using one and the same control even though the useful width of the loom may vary within limits.

Thus, the invention as described achieved its objects.

In practicing the invention, all of the details may be replaced with other technically equivalent ones without departing from the invention's scope.

I claim:

1. In a shuttleless loom with reciprocating weft thread insertion grippers and a respective transmission system for carrying said insertion grippers and cooperating with a respective gear wheel driving said respective transmission system, an actuating device for imparting reciprocating movement to said transmission system comprising a rocker arm including a pin at one end thereof and a pivot at the other end thereof, a connecting rod and crank assembly driven by a cyclic shaft of the shuttleless loom and including a linkage member having an articulation end thereof, an oscillating gear sector in driving engagement with said gear wheel and having a bisecting line thereof, said gear sector having (substantially along) the bisecting line thereof a slotted link type coupling including a slider, said coupling providing articulation both with said end of said linkage member of said connecting rod and with said pin of said rocker arm following the oscillations of said gear sector, thereby to guide the movement of said articulation end of said linkage member.

2. A control device according to claim 1, wherein said pivot has a main axis and said pin of said rocker arm is at an adjustable distance from said main axis, said pivot having an eccentric portion with an eccentric axis about which said rocker arm is arranged to swing, the angular position of said pivot about said main axis being adjustable.

3. An actuation device according to claim 1, wherein said gear sector has supporting means defining an axis of oscillation thereof and wherein said pivot of the rocker arm is positioned to the rear of said axis of oscillation of the gear sector.

4. An actuating device for reciprocating weft thread insertion grippers of a shuttleless loom, comprising a rocker arm having articulation means on one end thereof and pivot means on the other end thereof, a crank at a distance from said articulation means and driven by a cyclic shaft of the shuttleless loom, a connecting rod having one extremity thereof in articulation engagement with said articulation means and having another extremity thereof hingedly connected with said crank, an oscillating gear sector having shaft means for pivotally supporting it and defining an axis of oscillation thereof and arranged in a position intermediate said articulation means and said pivot means, said gear sector having a bisecting line, a raceway on said gear sector and extending along said bisecting line, a slider slidable within said raceway, linkage means for hingedly connecting said slider with said one extremity of connecting rod and said articulation means of said rocker arm and a transmission system for converting the oscillating motion of said gear sector into the reciprocating motion of said thread insertion grippers.

5. A device according to claim 4, wherein said transmission system comprises for each insertion gripper a pinion gear in mesh with said gear sector at a distance from said raceway and having a shaft rigid with said pinion gear and defining an axis of rotation of said pinion gear perpendicular to said axis of oscillation, a wheel member rigid with said shaft and coaxial therewith a belt in transmissive engagement with said wheel member, said belt carrying said insertion gripper at one end thereof and guide means for the reciprocating motion of said belt.

6. A device according to claim 5, wherein said gear sector has a gear rim segment arranged with respect to said axis of oscillation beyond said raceway thereby said raceway being arranged between said axis of oscillation and said gear rim.

7. A device according to claim 5, wherein said wheel member is a toothed wheel and said belt has engagement formations arranged at regular intervals for engagement with said toothed wheel.

8. A device according to claim 4, further comprising a pair of spaced apart supporting elements for said pivot means of the rocker arm and said shaft means for pivotally supporting said gear sector, said pivot means and said shaft means being parallel to each other and extending transverse to said supporting elements and arranged therebetween, and wherein said rocker arm has an arcuated shape for bypassing said shaft means to avoid interference therewith during the oscillating motion thereof.

9. A device according to claim 4, wherein said crank is arranged laterally at a distance from said gear sector thereby to maintain a significant angle between said connecting rod and said rocker arm in all positions of said gear sector.

* * * * *